US009422657B2

(12) United States Patent
Kwon et al.

(10) Patent No.: US 9,422,657 B2
(45) Date of Patent: Aug. 23, 2016

(54) WASHING MACHINE

(75) Inventors: Ig Geun Kwon, Changwon-si (KR); Soo Bong Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 912 days.

(21) Appl. No.: 13/259,016

(22) PCT Filed: May 28, 2010

(86) PCT No.: PCT/KR2010/003409
§ 371 (c)(1),
(2), (4) Date: Sep. 22, 2011

(87) PCT Pub. No.: WO2010/137912
PCT Pub. Date: Dec. 2, 2010

(65) Prior Publication Data

US 2012/0024020 A1 Feb. 2, 2012

(30) Foreign Application Priority Data

May 28, 2009 (KR) ..... 10-2009-0047192
Aug. 27, 2009 (KR) ..... 10-2009-0079909
May 18, 2010 (KR) ..... 10-2010-0046463

(51) Int. Cl.

| | |
|---|---|
| ***D06F 23/06*** | (2006.01) |
| ***D06F 37/26*** | (2006.01) |
| ***D06F 25/00*** | (2006.01) |
| ***D06F 37/20*** | (2006.01) |

(Continued)

(52) U.S. Cl.
CPC ..... *D06F 37/268* (2013.01); *D06F 23/06* (2013.01); *D06F 25/00* (2013.01); *D06F 37/20* (2013.01); *D06F 37/206* (2013.01); *D06F 37/22* (2013.01); *D06F 37/262* (2013.01); *D06F 37/263* (2013.01); *D06F 37/267* (2013.01); *D06F 37/269* (2013.01); *D06F 39/12* (2013.01)

(58) Field of Classification Search
CPC ..... D06F 23/06
See application file for complete search history.

(56) References Cited

U.S. PATENT DOCUMENTS 1,593,678 A 7/1926 Statler
2,856,699 A 10/1958 Frey (Continued)

FOREIGN PATENT DOCUMENTS

CN 1179489 A 4/1998
CN 1208787 A 2/1999

(Continued)

OTHER PUBLICATIONS

Russian Decision to Grant a Patent dated May 15, 2014 issued in Application No. 2011147481 (with English translation).

(Continued)

*Primary Examiner* — Jason Ko
(74) *Attorney, Agent, or Firm* — Ked & Associates, LLP

(57) ABSTRACT

The patent application refers to a washing machine including a cabinet rear (620) which forms a rear side of the washing machine, a tub (10) for holding washing water, a drum (30) rotatably mounted to the tub (10), a drum (30), a bearing housing (400) for rotatably supporting the rotation shaft (351), a motor for rotating the rotation shaft (351), and a suspension assembly (40) for supportably buffering vibration of the drum (30), wherein the washing machine further includes a coupling portion (124*a*) which is a projection from an outside surface of a rear side of the tub (10) for fastening to the cabinet rear (620).

6 Claims, 8 Drawing Sheets

(51) Int. Cl.
*D06F 37/22* (2006.01)
*D06F 39/12* (2006.01)

(56) References Cited

U.S. PATENT DOCUMENTS

| | | | | |
|---|---|---|---|---|
| 3,275,152 | A | 9/1966 | Searle | 210/64 |
| 3,387,310 | A | 6/1968 | Marshall | 8/158 |
| 3,509,742 | A | 5/1970 | Bauer | 68/23.1 |
| 4,033,047 | A | 7/1977 | Kawai | 34/82 |
| 4,204,339 | A | 5/1980 | Muller | 34/75 |
| 4,891,892 | A | 1/1990 | Narang | 34/86 |
| 4,899,462 | A | 2/1990 | Putnam et al. | 34/19 |
| 5,231,805 | A | 8/1993 | Sander | 51/429 |
| 5,259,218 | A | 11/1993 | Broadbent | 68/12.06 |
| 5,582,040 | A | 12/1996 | Khan | 68/23.2 |
| 5,711,170 | A | 1/1998 | Johnson | 68/3 |
| 5,735,006 | A | 4/1998 | Vande Haar | 8/158 |
| 6,256,823 | B1 | 7/2001 | Kronbetter et al. | 8/158 |
| 6,557,383 | B1 | 5/2003 | Ito et al. | 68/23.2 |
| 6,941,680 | B1 | 9/2005 | Zielewicz et al. | |
| 7,020,985 | B2 | 4/2006 | Casey et al. | |
| 7,020,986 | B1 | 4/2006 | Nakai et al. | |
| 7,168,274 | B2 | 1/2007 | Slutsky et al. | |
| 7,251,963 | B2 | 8/2007 | Kim et al. | 68/196 |
| 7,398,662 | B2 | 7/2008 | Kim et al. | 68/23 |
| 7,458,171 | B1 | 12/2008 | Lentz | |
| 8,028,439 | B2 | 10/2011 | Prajescu | |
| 8,201,345 | B2 | 6/2012 | Dalton et al. | |
| 8,256,137 | B2 | 9/2012 | Noviello et al. | |
| 8,438,750 | B2 | 5/2013 | Dittmer et al. | |
| 8,468,711 | B2 | 6/2013 | Kim et al. | |
| 8,490,294 | B2 | 7/2013 | Brunert | |
| 8,607,473 | B2 | 12/2013 | Choi et al. | |
| 8,615,895 | B2 | 12/2013 | Shin et al. | |
| 8,627,580 | B2 | 1/2014 | Kim et al. | |
| 8,627,581 | B2 | 1/2014 | Brown | |
| 8,661,707 | B2 | 3/2014 | Dittmer et al. | |
| 8,667,705 | B2 | 3/2014 | Shin et al. | |
| 8,800,165 | B2 | 8/2014 | Kwon et al. | |
| 8,863,401 | B2 | 10/2014 | Grunert et al. | |
| 8,984,767 | B2 | 3/2015 | Grunert et al. | |
| 8,997,377 | B2 | 4/2015 | Kim et al. | |
| 9,027,256 | B2 | 5/2015 | Kim et al. | |
| 2004/0107742 | A1 | 6/2004 | Kim et al. | 68/24 |
| 2004/0123631 | A1 | 7/2004 | Chang | |
| 2004/0148978 | A1 | 8/2004 | Kim et al. | 68/23 |
| 2004/0163426 | A1 | 8/2004 | Kim et al. | 68/23 |
| 2004/0221474 | A1 | 11/2004 | Slutsky et al. | 34/319 |
| 2004/0226321 | A1 | 11/2004 | Park et al. | 68/23.1 |
| 2004/0261469 | A1 | 12/2004 | Park et al. | 68/23 |
| 2005/0120715 | A1 | 6/2005 | Labrador | |
| 2005/0183472 | A1 | 8/2005 | Choi | 68/23.1 |
| 2005/0262879 | A1 | 12/2005 | Kim et al. | 68/3 |
| 2005/0274159 | A1 | 12/2005 | Jeon et al. | 68/23.1 |
| 2006/0010935 | A1 | 1/2006 | Park et al. | 68/3 |
| 2006/0016228 | A1 | 1/2006 | Chang et al. | 68/23.1 |
| 2006/0053838 | A1 | 3/2006 | Inuzuka et al. | 68/3 |
| 2006/0075791 | A1 | 4/2006 | Seo et al. | 68/23.1 |
| 2006/0101865 | A1 | 5/2006 | Jeon et al. | 68/3 |
| 2006/0169006 | A1 | 8/2006 | Lim et al. | 68/13 |
| 2006/0174663 | A1 | 8/2006 | Cimetta et al. | 68/3 |
| 2006/0174665 | A1 | 8/2006 | Namkung et al. | 68/140 |
| 2007/0051142 | A1 | 3/2007 | Lim et al. | 68/139 |
| 2007/0074543 | A1 | 4/2007 | Lim et al. | 68/140 |
| 2007/0227200 | A1 | 10/2007 | Kim et al. | 68/140 |
| 2007/0289339 | A1 | 12/2007 | Lim | 68/23.1 |
| 2008/0099052 | A1 | 5/2008 | Lee et al. | 134/18 |
| 2008/0264114 | A1 | 10/2008 | Jang et al. | 68/139 |
| 2008/0276656 | A1 | 11/2008 | Kitamura et al. | |
| 2008/0307833 | A1 | 12/2008 | Chang et al. | 68/23.1 |
| 2009/0056389 | A1 | 3/2009 | Pinkowski et al. | |
| 2009/0178442 | A1 | 7/2009 | Kawabata et al. | |
| 2009/0178445 | A1 | 7/2009 | Brinkmann | 68/23 |
| 2010/0306928 | A1 | 12/2010 | Kimm et al. | |
| 2011/0173834 | A1 | 7/2011 | Arrigoni et al. | 34/90 |
| 2012/0000087 | A1 | 1/2012 | Da Riol et al. | |
| 2012/0090189 | A1 | 4/2012 | Kwon et al. | |
| 2013/0091726 | A1 | 4/2013 | Kim et al. | |
| 2013/0139402 | A1 | 6/2013 | Hong | 34/427 |
| 2013/0205840 | A1 | 8/2013 | Hong et al. | |
| 2013/0219734 | A1 | 8/2013 | Kim et al. | |
| 2013/0255099 | A1 | 10/2013 | Cavarretta et al. | 34/108 |
| 2013/0263630 | A1 | 10/2013 | Doh et al. | |
| 2013/0291395 | A1 | 11/2013 | Doh et al. | |
| 2013/0318813 | A1 | 12/2013 | Hong et al. | |
| 2014/0150277 | A1 | 6/2014 | Kwon et al. | |
| 2014/0150279 | A1 | 6/2014 | Kwon et al. | |
| 2014/0208609 | A1 | 7/2014 | Han et al. | |

FOREIGN PATENT DOCUMENTS

| | | | |
|---|---|---|---|
| CN | 1508349 | A | 6/2004 |
| CN | 1511996 | A | 7/2004 |
| CN | 1540085 | A | 10/2004 |
| CN | 1548627 | A | 11/2004 |
| CN | 1707010 | A | 12/2005 |
| CN | 1724742 | A | 1/2006 |
| CN | 1730776 | A | 2/2006 |
| CN | 1730777 | A | 2/2006 |
| CN | 1730778 | A | 2/2006 |
| CN | 1814895 | A | 8/2006 |
| CN | 1844543 | A | 10/2006 |
| CN | 1906351 | A | 1/2007 |
| CN | 1940166 | A | 4/2007 |
| CN | 101046046 | A | 10/2007 |
| CN | 101173482 | | 5/2008 |
| CN | 101343826 | | 1/2009 |
| CN | 101381946 | A | 3/2009 |
| CN | 100513673 | C | 7/2009 |
| DE | 25 03 576 | A1 | 8/1976 |
| DE | 3438575 | A1 | 4/1986 |
| DE | 41 04 450 | A1 | 8/1992 |
| DE | 44 13 069 | A1 | 10/1994 |
| DE | 297 16 968 | U1 | 11/1997 |
| DE | 198 56 973 | A1 | 6/1999 |
| DE | 103 42 254 | B3 | 11/2004 |
| DE | 10 2006 012 035 | B3 | 3/2007 |
| DE | 10 2006 031 352 | A1 | 1/2008 |
| EP | 0 152 745 | A2 | 8/1985 |
| EP | 0 443 361 | A1 | 8/1991 |
| EP | 0 648 885 | A1 | 4/1995 |
| EP | 1 079 014 | A1 | 2/2001 |
| EP | 1 270 791 | A2 | 1/2003 |
| EP | 1 433 890 | A2 | 6/2004 |
| EP | 1 445 368 | A2 | 8/2004 |
| EP | 1 529 869 | A2 | 5/2005 |
| EP | 1 605 088 | A2 | 12/2005 |
| EP | 1 619 286 | A2 | 1/2006 |
| EP | 1 688 524 | A1 | 8/2006 |
| EP | 1 688 525 | A1 | 8/2006 |
| EP | 1 688 531 | A1 | 8/2006 |
| EP | 1 690 969 | A1 | 8/2006 |
| EP | 1 710 340 | A2 | 10/2006 |
| EP | 1 722 025 | A1 | 11/2006 |
| EP | 1 746 192 | A2 | 1/2007 |
| EP | 1 746 195 | A2 | 1/2007 |
| EP | 1 770 199 | A2 | 4/2007 |
| EP | 1 840 257 | A1 | 10/2007 |
| EP | 1 857 583 | A1 | 11/2007 |
| EP | 1 881 099 | A1 | 1/2008 |
| EP | 1 975 298 | A1 | 10/2008 |
| EP | 2 039 819 | A1 | 3/2009 |
| EP | 2 053 157 | A1 | 4/2009 |
| EP | 2 075 364 | A1 | 7/2009 |
| EP | 2 078 777 | A1 | 7/2009 |
| EP | 2 390 401 | A2 | 11/2011 |
| EP | 2 435 624 | A2 | 4/2012 |
| FR | 2 931 489 | A1 | 11/2009 |
| GB | 913801 | A | 12/1962 |
| GB | 1181797 | A | 2/1970 |
| GB | 2 091 123 | A | 7/1982 |
| GB | 2 279 968 | A | 1/1995 |
| JP | S52-131661 | A | 11/1977 |
| JP | H07-124382 | A | 5/1995 |

(56) References Cited

FOREIGN PATENT DOCUMENTS

| | | | |
|---|---|---|---|
| JP | H07-275591 | A | 10/1995 |
| JP | H10-211393 | A | 8/1998 |
| JP | 2003-245489 | A | 9/2003 |
| JP | 2004-000806 | A | 1/2004 |
| JP | 3502039 | B2 | 3/2004 |
| JP | 2006-061613 | A | 3/2006 |
| JP | 2007-282962 | A | 11/2007 |
| JP | 2008-006045 | A | 1/2008 |
| JP | 2008-259665 | A | 10/2008 |
| JP | 2009-028400 | A | 2/2009 |
| JP | 2009-060990 | A | 3/2009 |
| JP | 2009-61217 | | 3/2009 |
| KP | 10-2008-0078328 | A | 8/2008 |
| KR | 10-2000-0056255 | A | 9/2000 |
| KR | 10-2001-0071245 | A | 7/2001 |
| KR | 10-2002-0056323 | A | 7/2002 |
| KR | 10-2002-0091795 | A | 12/2002 |
| KR | 10-2003-0092185 | A | 12/2003 |
| KR | 10-2004-0046973 | A | 6/2004 |
| KR | 10-2005-0006330 | A | 1/2005 |
| KR | 10-2005-0022659 | A | 3/2005 |
| KR | 10-2005-0108609 | A | 11/2005 |
| KR | 10-2006-0009075 | A | 1/2006 |
| KR | 10-2006-0046969 | A | 5/2006 |
| KR | 10-0730919 | B1 | 6/2006 |
| KR | 10-2006-0095816 | A | 9/2006 |
| KR | 10-2006-0117528 | A | 11/2006 |
| KR | 10-0651853 | B1 | 11/2006 |
| KR | 10-2007-0059431 | A | 6/2007 |
| KR | 10-2007-0078602 | A | 8/2007 |
| KR | 10-2007-0101688 | A | 10/2007 |
| KR | 10-2007-0101732 | A | 10/2007 |
| KR | 10-2008-0002475 | A | 1/2008 |
| KR | 10-2008-0018747 | A | 2/2008 |
| KR | 10-0808192 | B1 | 2/2008 |
| KR | 10-2008-0072187 | A | 8/2008 |
| KR | 10-2008-0095565 | A | 10/2008 |
| RU | 2 085 641 | C1 | 7/1997 |
| RU | 2 182 197 | C2 | 5/2002 |
| RU | 2 303 092 | C1 | 7/2007 |
| RU | 2 303 668 | C2 | 7/2007 |
| WO | WO 01/96647 | A1 | 12/2001 |
| WO | WO 2005/017249 | A1 | 2/2005 |
| WO | WO 2007/105843 | A1 | 9/2007 |
| WO | WO 2008/003592 | A1 | 1/2008 |
| WO | WO 2008/007888 | A2 | 1/2008 |
| WO | WO 2008/103007 | A2 | 8/2008 |
| WO | WO 2009/040302 | A1 | 4/2009 |
| WO | WO 2009/050095 | A1 | 4/2009 |
| WO | WO 2009/148251 | A2 | 12/2009 |

OTHER PUBLICATIONS

United States Office Action dated Jun. 12, 2014 issued in U.S. Appl. No. 13/318,655.
United States Office Action dated Jun. 17, 2014 issued in U.S. Appl. No. 13/258,965.
International Search Report dated Nov. 29, 2010 issued in Application No. PCT/KR2010/003409.
United States Office Action dated Aug. 4, 2014 issued in U.S. Appl. No. 13/318,655.
United States Office Action dated Sep. 3, 2014 issued in U.S. Appl. No. 13/142,620.
United States Office Action dated Sep. 9, 2014 issued in U.S. Appl. No. 13/259,709.
United States Office Action dated Oct. 2, 2014 issued in U.S. Appl. No. 13/259,832.
United States Office Action dated Nov. 14, 2013 issued in U.S. Appl. No. 13/266,838.
European Search Report dated Oct. 19, 2012 issued in Application No. 10 78 0817.
European Search Report dated Oct. 22, 2012 issued in Application No. 10 78 0819.
European Search Report dated Oct. 24, 2012 issued in Application No. 10 78 0823.
European Search Report dated Oct. 26, 2012 issued in Application No. 10 78 0820.
European Office Action dated Jan. 2, 2014 issued in Application No. 10 780 822.2.
Russian Office Action dated Jan. 22, 2014 issued in Application No. 2011132074 (with English translation.).
Russian Office Action dated Jan. 30, 2014 issued in Application No. 2011147481 (with English translation).
European Office Action dated Feb. 5, 2014 issued in Application No. 10 780 817.2.
European Search Report dated Feb. 25, 2014 issued in Application No. 10 78 0803.2.
European Search Report dated Feb. 25, 2014 issued in Application No. 10 78 0805.7.
European Search Report dated Feb. 26, 2014 issued in Application No. 10 78 0804.0.
European Search Report dated Feb. 26, 2014 issued in Application No. 10 78 0806.5.
European Notice of Allowance dated Feb. 28, 2014 issued in Application No. 10 78 0823.0.
European Search Report dated Mar. 19, 2014 issued in Application No. 13 19 8677.0.
United States Office Action dated Apr. 11, 2014 issued in U.S. Appl. No. 13/320,697.
Chinese Office Action dated Mar. 5, 2013 issued in Application No. 201080017293.4 (with English translation).
Chinese Office Action dated Mar. 28, 2013 issued in Application No. 201080021257.5 (with English translation).
International Search Report and Written Opinion dated Sep. 14, 2010 issued in Application No. PCT/KR2009/007869.
International Search Report and Written Opinion dated Oct. 27, 2010 issued in Application No. PCT/KR2010/003379.
International Search Report and Written Opinion dated Oct. 27, 2010 issued in Application No. PCT/KR2010/003400.
International Search Report and Written Opinion dated Nov. 24, 2010 issued in Application No. PCT/K112010/003376.
International Search Report and Written Opinion dated Nov. 24, 2010 issued in Application No. PCT/KR2010/003377.
International Search Report and Written Opinion dated Nov. 24, 2010 issued in Application No. PCT/KR2010/003378.
International Search Report and Written Opinion dated Nov. 29, 2010 issued in Application No. PCT/KR2010/003404.
International Search Report and Written Opinion dated Nov. 29, 2010 issued in Application No. PCT/KR2010/003405.
International Search Report and Written Opinion dated Nov. 29, 2010 issued in Application No. PCT/KR2010/003409.
International Search Report and Written Opinion dated Nov. 29, 2010 issued in Application No. PCT/KR2010/003410.
International Search Report and Written Opinion dated Jan. 21, 2011 issued in Application No. PCT/KR2010/003406.
International Search Report and Written Opinion dated Jan. 31, 2011 issued in Application No. PCT/KR2010/003408.
International Search Report and Written Opinion dated Jul. 19, 2011 issued in Application No. PCT/KR2009/007963.
International Search Report and Written Opinion dated Sep. 21, 2011 issued in Application No. PCT/KR2009/007960.
European Search Report dated Jul. 31, 2012 issued in Application No. 09 83 6377.
Chinese Office Action dated Dec. 25, 2012 issued in Application No. 200980155851.0 (with English translation).
Chinese Office Action dated Dec. 28, 2012 issued in Application No. 200980155608.9 (with English translation).
Chinese Office Action dated Jun. 4, 2013 issued in Application No. 201080021259.4 (with English translation).
Chinese Office Action dated Jun. 4, 2013 issued in Application No. 201080022490.5 (with English translation).
Russian Decision to Grant a Patent dated Aug. 29, 2014 issued in Application No. 2011146320/12 (with English translation).
Russian Decision to Grant a Patent dated Aug. 29, 2014 issued in Application No. 2011147482/12 (with English translation).

(56) References Cited

OTHER PUBLICATIONS

United States Office Action dated Nov. 6, 2014 issued in U.S Appl. No. 13/142,986.
United States Office Action dated Nov. 18, 2014 issued in U.S Appl. No. 13/143,032.
United States Office Action dated May 6, 2015 issued in U.S. Appl. No. 13/259,754.
United States Final Office Action dated May 18, 2015 issued in U.S. Appl. No. 13/319,167.
United States Office Action dated Dec. 29, 2014 issued in U.S. Appl. No. 13/266,895.
United States Final Office Action dated Jan. 9, 2015 issued in U.S. Appl. No. 13/318,655.
United States Final Office Action dated Jan. 21, 2015 issued in U.S. Appl. No. 13/142,620.
ABT-MAH2400WH.pdf, web page posted on www.abt.com on Mar. 2009; https://web.archive.org/web/20090301015816/http://www.abt.com/__product/17027/Maytag-MAH2400AWW.html; retrieved by Examiner on Mar. 19, 2015.
Maytag-MAH2400AWW.pdf, web page posted on www.maytag.com on May 2005; https://web.archive.org/web/20050502164236/http://www.maytag.com/mths/products/product.jsp?model=MAH2400AWWW; retrieved by Examiner on Mar. 19, 2015.
Amazon-MAH2400AWW.pdf, web page posted on www.amazon.com on Mar. 2015; http:/www.amazon.com/Maytag-MAH2400AWWCompact-Front-Load-Capacity/dp/8000UVYEOM/ref=cm__cd__ql__qh__dp__t; retrieved by Examiner on Mar. 19, 2015.
United States Office Action dated Feb. 5, 2015 issued in U.S. Appl. No. 13/319,167.
United States Final Office Action dated Mar. 16, 2015 issued in U.S. Appl. No. 13/143,032.
United States Office Action dated Mar. 26, 2015 issued in U.S. Appl. No. 13/318,549.
United States Final Office Action dated Apr. 9, 2015 issued in U.S. Appl. No. 13/320,697.
United States Office Action dated Jun. 5, 2015 issued in U.S. Appl. No. 13/142,986.
United States Office Action dated Sep. 1, 2015 issued in U.S. Appl. No. 13/320,697.
Chinese Office Action issued in Application No. 201410148938.8 dated Aug. 21, 2015.
Chinese Office Action issued in Application No. 201410149092.X dated Aug. 21, 2015.
Chinese Office Action issued in Application No. 201410148940.5 dated Aug. 25, 2015.
Chinese Office Action issued in Application No. 201410148311.2 dated Sep. 2, 2015.
European Office Action issued in Application No. 13 198 681.2 dated Oct. 8, 2015.
Final Office Action issued in co-pending U.S. Appl. No. 13/142,620 dated Nov. 16, 2015.
U.S. Office Action issued in U.S. Appl. No. 13/143,032 dated Jun. 29, 2015.
U.S. Office Action issued in U.S. Appl. No. 13/318,655 dated Jun. 30, 2015.
U.S. Notice of Allowance issued in U.S. Appl. No. 14/173,892 dated Jul. 27, 2015.
U.S. Notice of Allowance issued in U.S. Appl. No. 14/173,948 dated Jul. 27, 2015.
U.S. Notice of Allowance issued in U.S. Appl. No. 14/173,908 dated Jul. 28, 2015.
U.S. Office Action issued in U.S. Appl. No. 14/173,928 dated Jul. 30, 2015.
U.S. Office Action issued in U.S. Appl. No. 13/142,620 dated Aug. 3, 2015.
U.S. Final Office Action issued in co-pending U.S. Appl. No. 13/320,697 dated Feb. 23, 2016.

WASHING MACHINE

TECHNICAL FIELD

The present invention relates to washing machines, and more particularly, to a washing machine in which a tub thereof is improved for increasing a capacity of the washing machine.

BACKGROUND ART

In general, the washing machine removes various kinds of contaminants from clothes and beddings by using a softening action of detergent, friction of water flow and impacts applied to laundry caused by rotation of a pulsator or a drum. Current full automatic washing machine carries out a series of courses of washing, rinsing, spinning, and so on automatically without intermittent handling of a user.

It is a current trend that demands for the drum type washing machine increase gradually, which, not only enables to reduce a total height, but also does not cause problems of entangling and crumpling of the laundry compared to a pulsator type washing machine in which a washing tub rotates in an upright position.

A structure of the drum type washing machine will be described briefly. The drum type washing machine is provided with a body cabinet which forms an exterior of the drum type washing machine, a tub in the body cabinet supported by dampers and springs for holding washing water, and a cylindrical drum in the tub for placing the laundry therein, wherein the drum has driving power applied thereto by a driving unit for washing the laundry placed therein.

The drum type washing machine inevitably causes vibration due to rotation force of the drum, eccentricity of the laundry, and the like at the time the drum rotates for washing or spinning the laundry introduced to the drum, and the vibration caused by the rotation of the drum is transmitted to an outside of the drum type washing machine through the tub and the cabinet.

Consequently, in order to prevent the vibration from transmitting to the cabinet from the drum through the tub, springs and dampers are provided between the tub and the cabinet for buffering and damping the vibration of the tub, without fail.

In the meantime, the drum type washing machine is mostly installed, not independently, but in conformity with an existing installation environment (for an example, a sink environment or a built-in environment). Therefore, it is required that a size of the drum type washing machine is limited to the installation environment.

Thus, because change of an inside structure of the drum type washing machine is limited by the spring and damper which are provided for damping the vibration between the tub and the cabinet, and the installation environment of the drum type washing machine is limited, change of the size of the drum type washing machine itself is limited.

In the meantime, currently, in order to increase an amount of washing and user s convenience, many researches and developments are undergoing for increasing a washing capacity of the washing machine. However, above limitations impose many difficulties on the increasing of the size of the tub for increasing the washing capacity in an existing drum type washing machine structure.

Consequently, a variety of structures of washing machines are being developed for increasing the washing capacity.

DISCLOSURE OF INVENTION

Technical Problem

To solve the problems, an object of the present invention is to provide a washing machine having a new structure completely different from the related art washing machine. Along with this, another object of the present invention is to provide a washing machine in which a structure of the tub is improved.

Solution To Problem

To achieve these objects and other advantages and in accordance with the purpose of the invention, as embodied and broadly described herein, a washing machine includes a cabinet rear which forms a rear side of the washing machine, a tub for holding washing water, a drum rotatably provided to the tub, a driving unit having a rotation shaft connected to the drum, a bearing housing for rotatably supporting the rotation shaft, and a motor for rotating the rotation shaft, and a suspension assembly for supportably buffering vibration of the drum, wherein the washing machine further includes a coupling portion which is a projection from an outside circumferential surface of a rear side of the tub for fastening the tub to the cabinet rear.

Preferably, the coupling portion is a projection from opposite sides of an upper side of the tub in an outside circumferential surface direction of the tub. Preferably, the coupling portion further includes a coupling boss which is an extension toward a length direction of the tub from the coupling portion.

In the meantime, preferably, the coupling boss is extended beyond the driving unit in a rear direction of the tub. And, preferably, the coupling boss includes a plurality of reinforcing ribs for reinforcing strength of the coupling boss with respect to the coupling portion.

Preferably, the tub is tilted by a predetermined angle such that a front side of the tub faces upward, and the coupling boss is an extension parallel to the tub.

In the meantime, preferably, the cabinet rear includes a securing portion which is a projection toward the coupling boss to a position to match with the coupling boss. And, preferably, the securing portion has an end portion with a slope as much as a tilting angle of the coupling boss. And, preferably, the cabinet panel has a service panel provided at a center portion and the securing portion is on an outside of the service panel.

In the meantime, preferably, the suspension assembly is connected to the bearing housing. And, preferably, the washing machine further includes a rear gasket for sealing such that the washing water does not leak from a space between the tub and the driving unit and enabling the driving unit to move relative to the tub. And, preferably, the tub is supported rigidly more than the drum being supported by the suspension assembly.

In the meantime, the washing machine can have the tub fixedly mounted thereto, or supported by a flexible supporting structure, like a suspension assembly. Or the washing machine can be supported to an extent intermediate between the supporting and the suspension and the fixed mounting.

That is, the tub can be supported fixedly to an extent similar to the suspension assembly to be described later, or rigidly more than supporting with the suspension. For an example, the tub can be supported by the suspension, or by ones, such as rubber bushings, for providing a certain extent of flexibility to the tub even though the supporting is not flexible more than the suspension.

More examples, in which the tub is supported rigidly more than the suspension assembly, are as follows;

First, at least a portion of the tub can be formed as one unit with the cabinet.

Second, the tub can be supported connected with screws, rivets, or rubber bushings, or supported secured with welding, adhesive sealing, or the like. In this case, those connections may have rigidity greater than the suspension assembly with respect to up/down directions which are major vibration directions of the drum.

The tub can have a shape enlarged within a space the tub is mounted therein as far as possible. That is, the tub can be enlarged close to a wall or a frame (for an example, left or right side plate of the cabinet) that limits a left/right direction size of the space at least in left/right directions (a direction perpendicular to an axis direction of a rotation shaft in a horizontal direction). The tub can be fabricated as one unit with the left or right side wall of the cabinet.

Relatively, the tub can be formed closer to the wall or the frame than the drum in the left/right directions. For an example, the tub can be formed to be spaced from the wall or the frame less than 1.5 time of a space to the drum. In a state the tub is enlarged in the left/right directions thus, the drum also can be enlarged in the left/right directions. The smaller the left/right direction spaces between the tub and the drum, the drum can be enlarged the more. In reducing the left/right direction spaces between the tub and the drum, left/right direction vibration of the drum can be taken into account. The smaller the left/right direction vibration of the drum, a diameter of the drum can become the greater. Therefore, the suspension assembly which attenuates the vibration of the drum can be made to have left/right direction rigidity greater than other direction rigidity. For an example, the suspension assembly can be made to have rigidity with respect to a left/right direction deformation the greatest compared to rigidity in other directions.

Different from the related art, the suspension assembly can be directly connected to the bearing housing which supports the rotation shaft connected to the drum, without passed through the tub. That is, the bearing housing can include a supporting portion for supporting the rotation shaft and an extension extended therefrom, and the suspension assembly can be fastened to the supporting portion or the extension of the bearing housing.

In this instance, the suspension assembly can include a bracket extended in an axis direction of the rotation shaft. And, the bracket can be extended forward toward the door.

In the meantime, the suspension assembly can include at least two suspensions spaced in an axis direction of the rotation shaft.

The suspension assembly can include a plurality of suspensions which are mounted under the rotation shaft for standably supporting an object of supporting (for an example, the drum). Or, the suspension assembly can include a plurality of suspensions which are mounted over the rotation shaft for suspendably supporting an object of supporting. Those cases are of types in which the suspensions are provided only under or over the rotation shaft for supporting.

A center of gravity of an oscillating body including the drum, the rotation shaft, the bearing housing, and the motor can be positioned on a side of the motor with reference to at least a length direction geometric center of the drum.

One of the suspensions can be positioned in front or rear of the center of gravity. Moreover, the suspensions can be mounted in front and rear of the center of gravity, respectively.

The tub can have a rear opening. A driving unit including the rotation shaft, the bearing housing, and the motor can be connected to the tub through a flexible member. The flexible member can be made to seal such that water does not leak through the rear opening of the tub, and to enable the driving unit to move relative to the tub. The flexible member can be fabricated such that the flexible member can seal leakage of the washing water through an opening in a rear side of the tub and the driving unit can make movement relative to the tub. The flexible member may be of any material as far as the material can function as a seal and is flexible. For an example, the flexible member may be formed of a gasket material like the front gasket. In this case, for convenience s sake, the flexible member may be called as a rear gasket with reference to the front gasket. The rear gasket can be connected to the driving unit in a state the rear gasket is limited not to rotate at least in a rotation direction of the rotation shaft. As an embodiment, the rear gasket can be connected to the rotation shaft directly, or to the extension of the bearing.

A portion of the driving unit positioned in front of a connection portion to the rear gasket so as to be vulnerable to exposure to the washing water in the tub can be made to be prevented from corrosion by the washing water. For an example, the portion may be coated, or a front surface thereof may be covered with an additional component (for an example, a tub back to be described late) of plastic. Parts of the driving unit formed of metal can be prevented from corrosion by preventing the parts from direct exposure to the water.

Along with this, different from the embodiment, the cabinet may not be included to the washing machine. For an example, in a case of a built-in washing machine, a space the washing machine is to be installed therein may be provided, not by the cabinet, but by a wall structure. That is, the washing machine can be fabricated in a shape with does not include the cabinet which forms an exterior, independently. However, in this case too, the front frame can be required for a front exterior.

Advantageous Effects of Invention

The washing machine of the present invention has following advantageous effects.

The modification of a shape of the tub taking movement of the drum into account permits to prevent the drum from interfering with the tub.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

In describing the present invention, names of elements are defined taking functions thereof into account. Therefore, it is required to understand that the names do not limit the elements technically. Moreover, the names of the elements may be called differently in this field of art.

Figure 1:
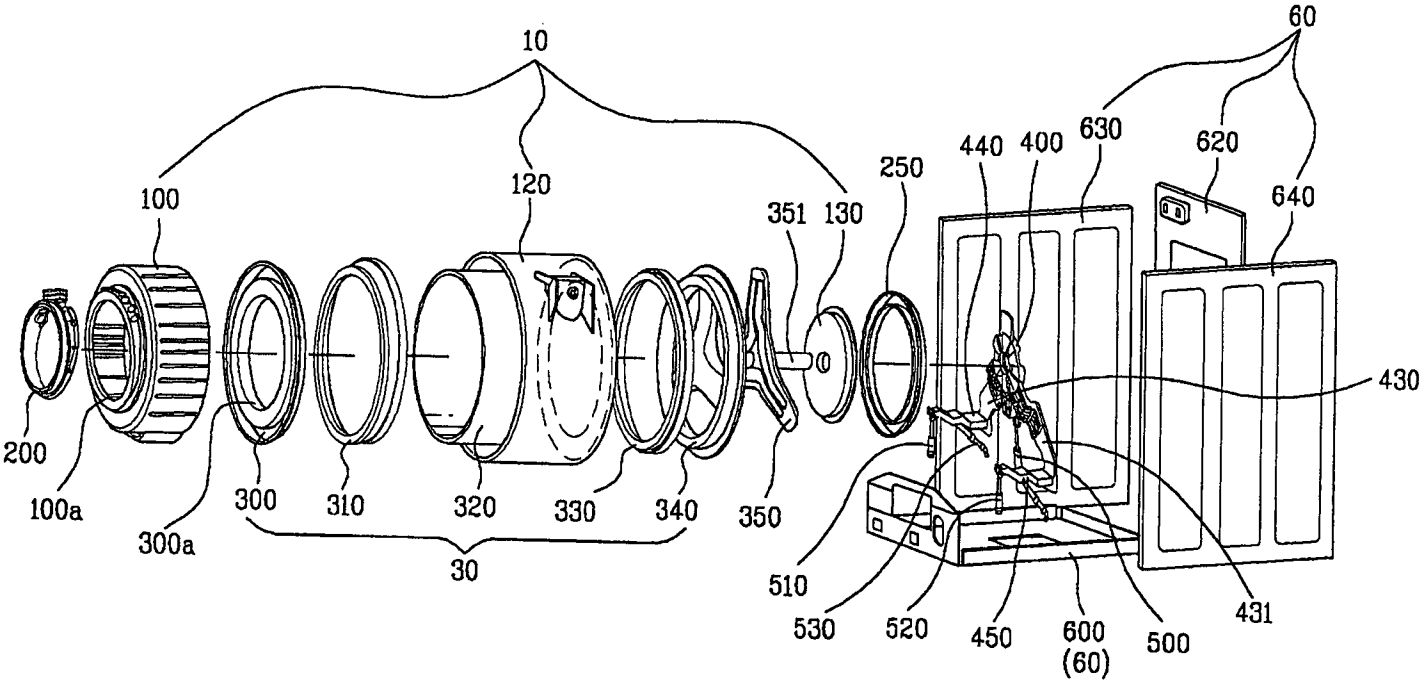
FIG. 1 illustrates an exploded perspective view of a washing machine in accordance with a preferred embodiment of the present invention.

FIG. 1 illustrates an exploded perspective view of a washing machine in accordance with a preferred embodiment of the present invention.

Referring to FIG. 1, the washing machine has a tub 10 fixedly secured to a cabinet. The tub includes a tub front 100 which forms a front portion thereof and a tub rear 120 which forms a rear portion thereof. The tub front 100 and the tub rear 120 are fastened together with screws for forming a space for placing a drum therein. The tub also includes a tub back 130 which forms a rear surface thereof. The tub back 130 is connected to the tub rear 120 with a rear gasket 250. The rear gasket 250 is formed of a flexible material for preventing vibration from transmitting to the tub rear 120 from the tub back 130.

The cabinet 60 forms an exterior of the washing machine. The cabinet 60 has a cabinet front (not shown), a cabinet rear 620, a cabinet left 640, a cabinet right 640, a cabinet right 630, a cabinet top (not shown), and a cabinet base 600.

The tub rear 120 has a rear surface 128. The rear surface 128 of the tub rear 120, the tub back 130, and the rear gasket 250 form a rear wall surface of the tub 10. The rear gasket 250 is sealably connected to the tub back 130 and the tub rear 120 respectively for preventing the washing water from leaking from the tub 10. The tub back 130 vibrates together with the drum 30 when the drum 30 rotates. In order to prevent the tub back 130 from interfering with the tub rear 120 at the time the tub back 130 vibrates, the tub back 130 is spaced from the tub rear 120, adequately. Since the rear gasket 250 is formed of a flexible material, the rear gasket 250 allows the tub back 130 to make relative motion without interference with the tub rear 120. The rear gasket 250 may have a corrugated portion 252 (See FIG. 4) which can be extended adequately for allowing the relative motion of the tub back 130.

A foreign matter getting in preventive member 200 is connected to a front of the tub front 100 for preventing foreign matters from entering between the tub 10 and the drum 30. The foreign matter getting in preventive member 200 is formed of a flexible material, and fixedly mounted to the tub front 100. The foreign matter getting in preventive member 200 may be formed of a material the same with the rear gasket 250.

The drum 30 includes a drum front 300, a drum center 320, and a drum back 340. The drum front 300 has a laundry opening for introducing the laundry to the drum 30. Ball balancers 310 and 330 are mounted to a front portion and a rear portion of the drum 30, respectively. The drum back 340 is connected to a spider 350, and the spider 350 is connected to a rotation shaft 351. The drum 30 rotates in the tub by rotation force transmitted thereto through the rotation shaft 351.

The rotation shaft 351 is passed through the tub back 130 and connected to the motor in a direct manner. More specifically, a rotor (not shown) of the motor and the rotation shaft 351 are connected, directly. There is a bearing housing 400 coupled to the rear surface 128 of the tub back 130. The bearing housing 400 rotatably supports the rotation shaft 351 between the motor and the tub back 130.

A stator is fixedly mounted to the bearing housing 400. The rotor is positioned around the stator. As described before, the rotor is directly connected to the rotation shaft 351. The motor, being an outer rotor type motor, is connected to the rotation shaft 351, directly.

Figure 5:
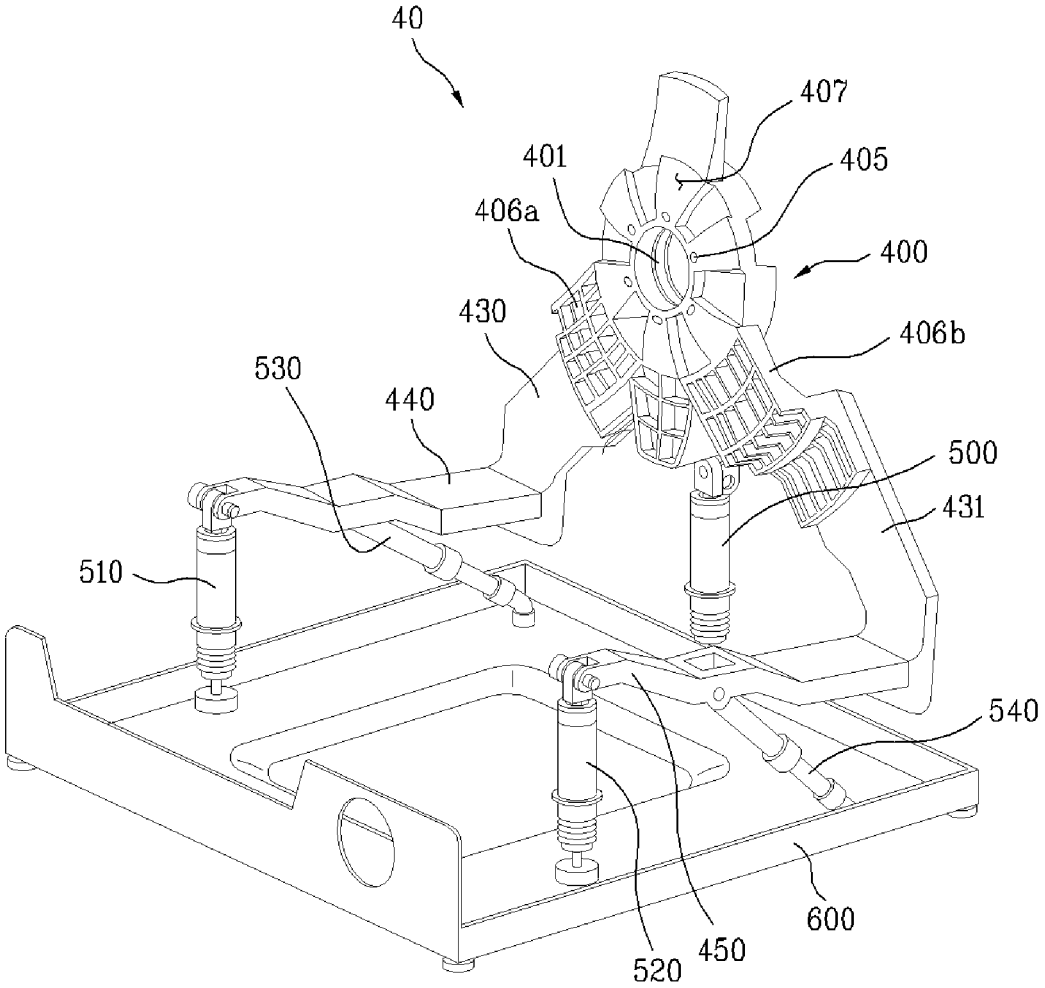
FIG. 5 illustrates a suspension of a washing machine in accordance with a preferred embodiment of the present invention.

The bearing housing 400 is supported on a cabinet base 600 through a suspension assembly 40 (See FIG. 5). The suspension assembly 40 includes three spring cylinder dampers 500, 510 and 520 and two cylinder dampers 530 and 540 for supporting in front/rear directions in a tilted positions. The suspension assembly 40 is connected to the cabinet base 600, not fixedly perfectly, but to allow a certain extent of elastic deformation to allow the drum 30 to move in front/rear and left/right directions.

That is, the suspension assembly 40 is elastically supported to allow a certain extent of rotation of the suspension assembly 40 in front/rear and left/right directions with respect to a supporting point at which the suspension assembly 40 is connected to the base 600. In order to make such elastic supporting available, the vertical suspensions may be mounted to the base 600 with rubber bushings disposed therebetween, respectively. Of the suspensions, it can be configured that the vertical suspensions elastically buffer vibration of the drum, and the tilted suspensions dampens the vibration of the drum 30. That is, it can be configured that, of a vibration system having springs and damping means, ones mounted in vertical positions serve as springs and ones mounted in a tilted positions serve as damping means.

The tub 10 is fixedly mounted to the cabinet except the tub back 130, and the vibration of the drum 30 is buffered and supported by the suspension assembly 40. It can be said that supporting structures for the tub 10 and the drum 30 are separated from each other actually, such that the tub 10 does not vibrate even if the drum 30 vibrates.

Respective parts will be described in detail.

Figure 2:
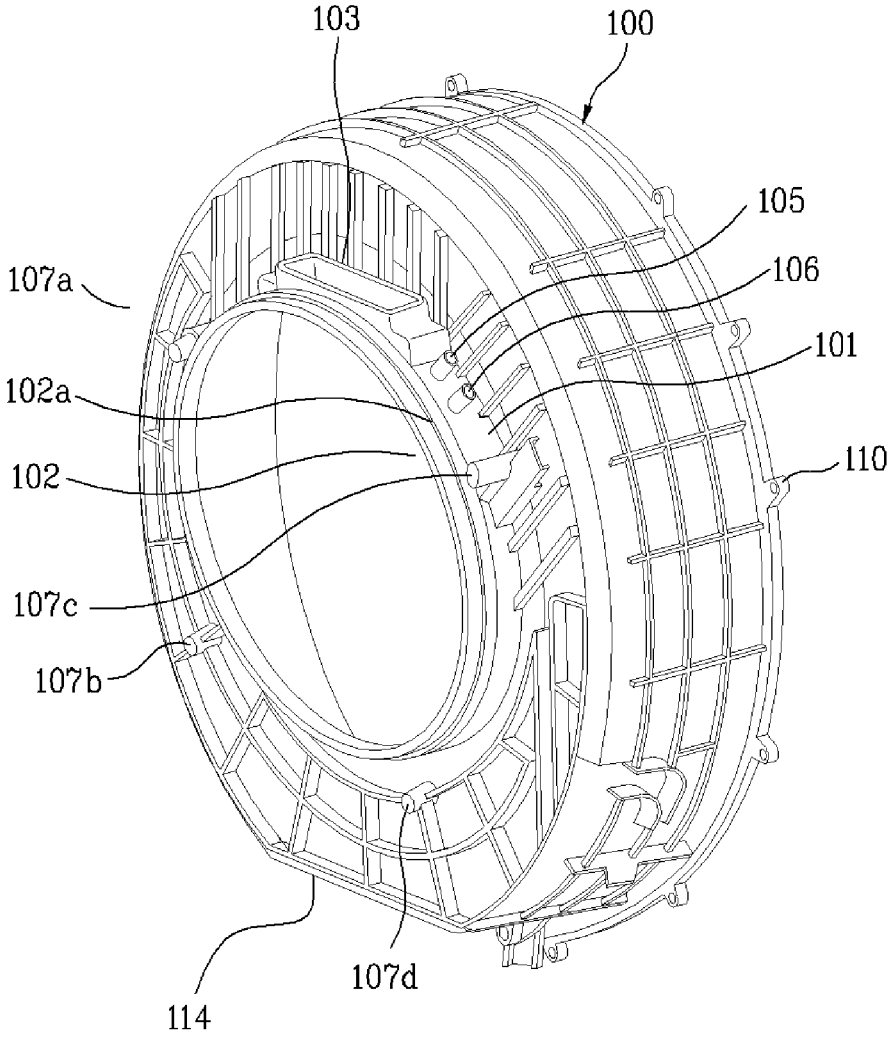
FIGS. 2 and 3 illustrate perspective views of tub fronts of a washing machine in accordance with a preferred embodiment of the present invention, respectively.
Figure 3:
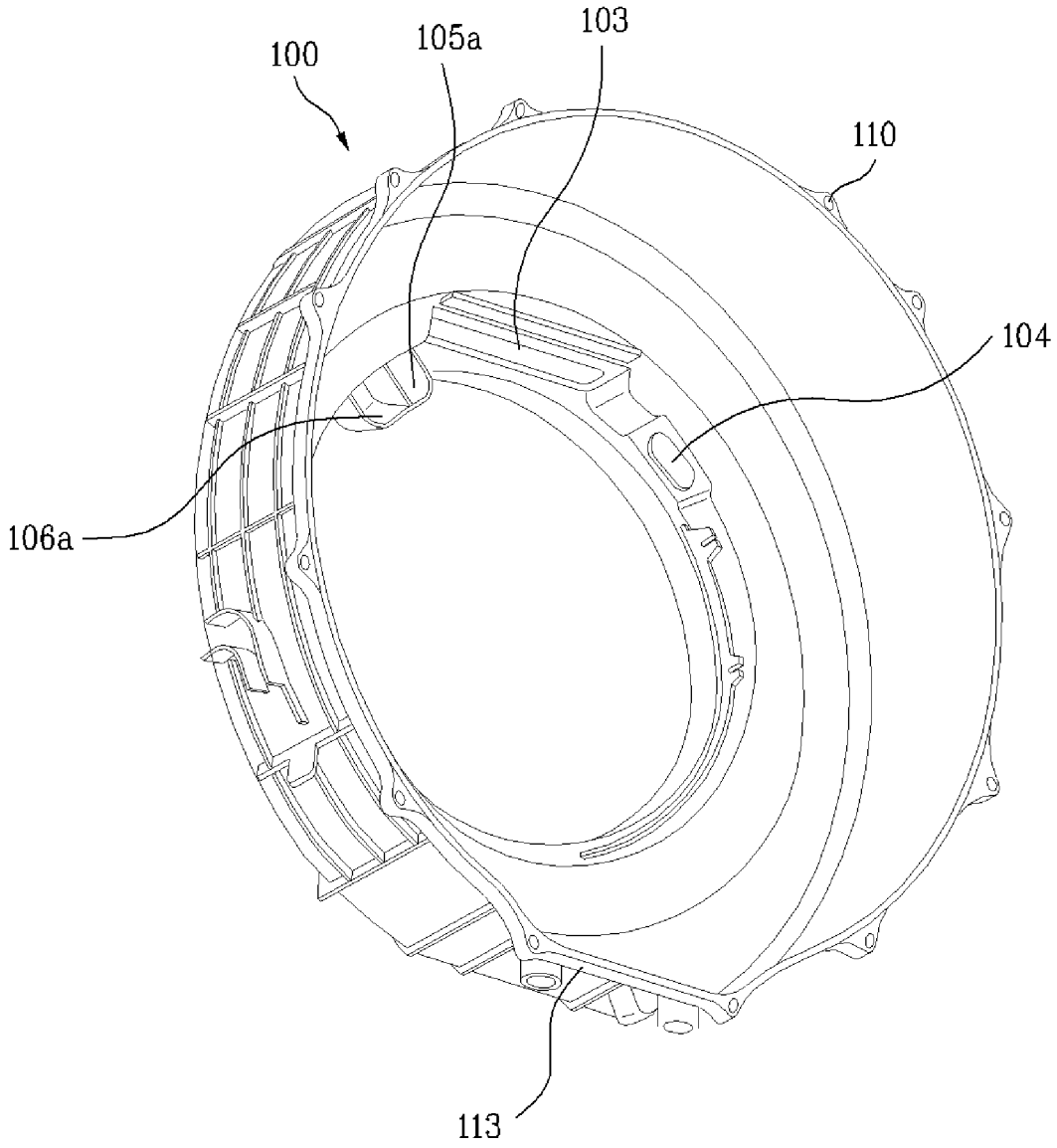

FIGS. 2 and 3 disclose the tub front 100. The tub front 100 has a donut shaped vertical front surface at a front side of a cylindrical surface which is a portion of a sidewall of the tub 10. The front surface has a laundry opening **100*a* for introduction of the laundry. A rear side of the cylindrical surface is opened the same as an opening of the cylinder of the tub front 100, and has a plurality of fastening holes 110. The fastening holes 110 are fastened to fastening holes 127 (See FIG. 4) in the tub rear 120** matched thereto, respectively.

A rim portion 101 is extended forward from an inside circumferential surface of a front surface 112 of the tub front 100. The rim portion 101 has a width which becomes the smaller as the rim portion 101 goes from an upper side to a lower side the more. There may not be the rim portion 101 formed on a lower side of an inner edge of the front surface 112, actually.

The rim portion 101 has a water supply inlet 104, a hot air inlet 103 to be used for drying, a circulating water inlet 106 for inlet of washing water circulated by a circulating pump, and a steam inlet 105 for introduction of steam.

Since the washing machine of the present invention has vibration of the tub 10 reduced significantly, connections of a water supply structure, such as the water supply hose for supplying washing water, a structure for drying, such as drying duct, a structure for supplying steam, a structure for supplying the circulating water, and so on can be held in position, securely.

The hot air inlet 103 is an upward rectangular shaped extension from the rim portion 101, substantially. The hot air inlet 103 is required for a washing and drying machine, and may not be required for a washing machine which has no drying function.

Since the water supply inlet 104, the hot air inlet 103 and so on are formed in the front portion of the tub front 100, supply of the washing water, the hot air and so on are made at the front side of the tub 10.

The water supply inlet 104 and so on can be positioned in front of a front end of the drum 30 which is housed in the tub 10. Accordingly, the washing water, the hot air and so on can be introduced to the drum 30 directly through the laundry opening provided for laundry in/out. Since fluids which are supplied for treating the laundry, such as the washing water, the hot air and so on, can be introduced to the drum 30 directly, effective treatment of the laundry is possible.

Moreover, in a case detergent is supplied together with the washing water which is supplied through detergent box, if the detergent is introduced to the drum 30 directly, consumption of the detergent can be reduced, enabling to reduce an amount of the washing water, accordingly.

And, a problem of contamination of a bottom of the tub 10 by deposition of detergent sediments can be reduced. Furthermore, the water supply from the front of the tub 10 can have an effect of washing door glass (not shown).

Even if the hot air is supplied from the front of the tub 10, if the hot air is supplied through a vertical surface of the tub front 100, since a flow of the hot air undergoes two times of bending to form a '⊂'-shape (a '⊂'-shaped complicate flow is formed as the hot air introduced into the tub 10 is bent downward at a front of the tub 10 and bent forward of the tub 10 again), the flow of the hot air can be poor. However, if the hot air inlet 103 is formed in the rim portion 101 of the tub front 100, the flow of the hot air can be smooth since the hot air flow is required to bend only once, vertically.

The water supply inlets 104 and so on are positioned above a center point of the drum. The washing water and so on are supplied to the drum 30 from an upper side of the front of the drum. If, different from this, if it is required to supply the washing water and so on to the drum 30 from a lower side of the front of the drum, the rim portion 101 of the tub front 100 may be formed at the lower side of the front surface 112, accordingly. If it is required to supply the washing water and so on to the drum, not from the upper or lower side, but from a left or right side of the drum, the rim portion 101 can be formed in the vicinity of a center portion of an inside edge of the front surface 112, accordingly. That is, a shape of the rim portion 101 can vary with a direction of supply of the fluids.

In a front edge of the rim portion 101, there is a coupling portion 102 for coupling the foreign matter getting in preventive member 200 thereto. The coupling portion 102 is a forward extension from a front end of the rim portion 101 to form a small cylindrical surface, substantially. The small cylindrical surface has a rib 102*a* formed on an outside circumferential surface of the small cylindrical surface.

The foreign matter getting in preventive member 200 is coupled to the coupling portion 102 as the coupling portion 102 is placed in the foreign matter getting in preventive member 200. Accordingly, the foreign matter getting in preventive member 200 has a groove (not shown) for placing the small cylindrical surface having the rib 102*a* formed therein.

The tub front 100 is fixedly connected to the cabinet front (not shown). For this fixed connection of the tub front 100, fastening bosses 107*a*, 107*b*, 107*c* and 107*d* are formed on the front surface of the tub front 100 around the rim portion 101, substantially. After positioning the cabinet front (not shown) in a state the tub front 100 is mounted, the cabinet front (not shown) is fastened to the tub front 100 by fastening screws from a front side to a rear side.

FIG. 3 illustrates a perspective view of the tub front 100 seen from a back side thereof. The steam inlet 105 can be connected to a steam hose. The steam inlet 105 has a steam guide 105*a* for guiding the steam introduced thereto to an inside of the drum. The circulating water inlet 106 has a circulating water guide 106*a* for guiding the circulating water introduced to the circulating water inlet 106 to the inside of the drum. The steam inlet 105, the circulating water inlet 106, the steam guide 105*a* and the circulating water guide 106*a* are formed as one unit with the tub front 100. The tub front 100 of plastic is injection molded together with the steam inlet 105 and so on as portions of the tub front 100.

The tub front 100 is coupled to the tub rear 120 to form a space for housing the drum 30. The tub front 100 and the tub rear 120 are fastened with screws. For this screw fastening, the tub front 100 has a plurality of screw fastening holes 110 formed along a circumference of a rear portion thereof.

Figure 4:
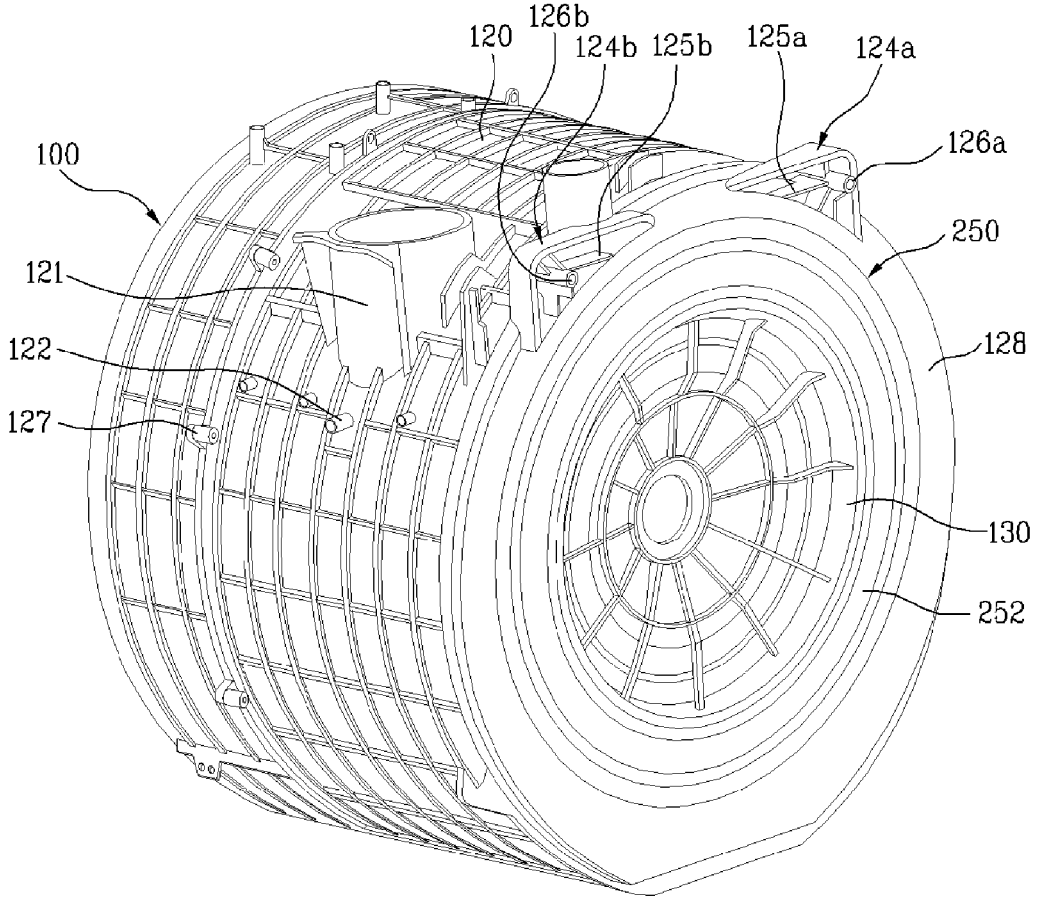
FIG. 4 illustrates a rear perspective view of a tub rear of a washing machine in accordance with a preferred embodiment of the present invention.

FIG. 4 illustrates the tub front 100, the tub rear 120, the tub back 130, and the rear gasket 250 assembled together.

The tub rear 120 is cylindrical to surround the drum 30, and has an opened front opened as it is, and a donut shaped rear surface 128. The front is sealably coupled to the tub front 100. The rear surface of the tub rear 120 has a diameter adequately greater than the outside diameter of the tub back 130, so that a gap is formed enough to prevent the tub back 130 from interfering with the rear surface of the tub rear 120 even if the tub back 130 vibrates.

And, between the rear surface of the tub rear 120 and the tub back 130, there is the rear gasket 250 connected thereto. The rear gasket 250 seals between the rear surface of the tub rear 120 and the tub back 130. The rear gasket 250 has a corrugated portion 252 having an adequate flexibility for not interfering with the vibration of the tub back 130.

The tub rear 120 has a hot air outlet 121 on one side for the washing and drying machine. It is natural that the hot air outlet 121 is not required if the washing machine is not the washing and drying machine, but a washing machine only for washing.

In the meantime, on undersides of the tub front 100 and the tub rear 120, there are additional structures for securing and supporting the tub 10 on the base.

Figure 6:
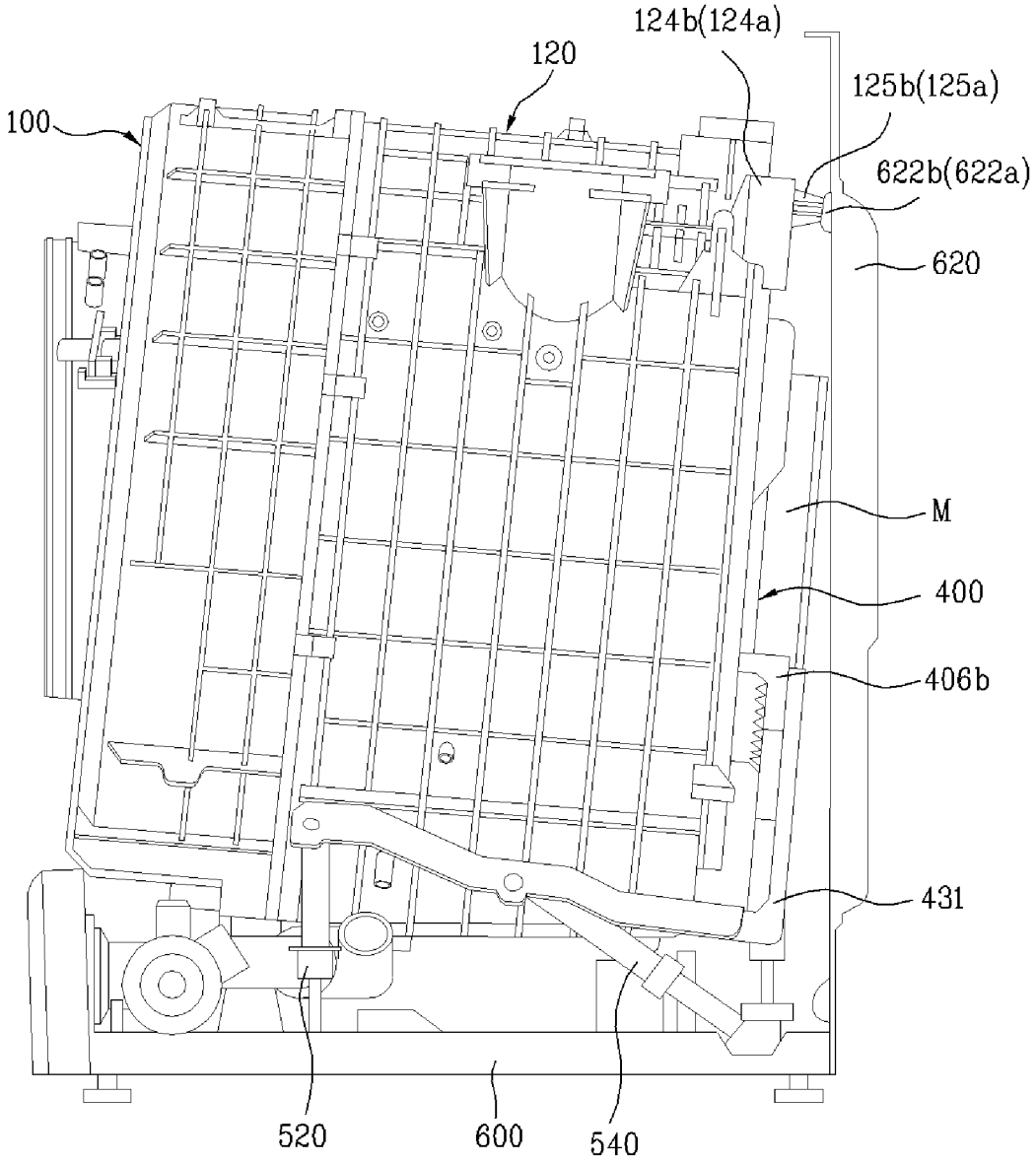
FIG. 6 illustrates a side view of an assembly of a tub and a suspension assembly of a washing machine in accordance with a preferred embodiment of the present invention.

FIG. 5 illustrates a perspective view showing a suspension assembly 40 mounted on the base 600. FIG. 6 illustrates a side view of an assembly of the tub 100 and 120, the bearing housing 400, and the suspension assembly 40.

The bearing housing 400 includes a bearing supporting portion 401 for supporting the bearings. On a front side of the bearing housing 400, there is a tub back fastening portion 407 formed thereon. On a rear side of the bearing housing 400, there is a stator fastening portion 402 formed thereon.

In this instance, the suspension assembly 40 includes the bearing housing 400, a first tilted bracket 431 and a second tilted bracket 430, and a first suspension bracket 450 and a second suspension bracket 440.

There are a first extension 406*a* and a second extension 406*b* which are extensions from the bearing housing 400 in a radial direction to left and right sides thereof. The first extension 406*a* and the second extension 406*b* have a first tilted bracket 431 and a second tilted bracket 430 connected thereto, respectively. The first tilted bracket 431 and the second tilted bracket 430 have the first suspension bracket 450 and the second bracket 440 connected thereto, respectively.

In this instance, the first extension 406*a*, the first tilted bracket 431, the first suspension bracket 450 and the second extension 440, the second tilted bracket 430, the second suspension bracket 440 are symmetry. In this instance, the first, and second tilted brackets 431 and 430 serves to balance a center of gravity of the drum when laundry is introduced to the drum, and as mass in a vibration system in which the drum 30 vibrates.

The suspension assembly 40 may include a first spring cylinder damper 520, a second spring cylinder damper 510, a third spring cylinder damper 500 which are arranged in a vertical direction for vertical direction buffering, and a first cylinder damper 540 and a second cylinder damper 530 arranged in a tilted position for front/rear direction buffering.

In this instance, of the first spring cylinder damper 520, the second spring cylinder damper 510 and the third spring cylinder damper 500, one may be arranged on a rear side and two may be arranged on left/right sides on a front side of a center of the base 600. And, the first cylinder damper 540 and the second cylinder damper 530 may be arranged in a front/rear direction on left/right sides with reference to the center in a tilted position.

In detail, the first cylinder damper 540 is connected between the first suspension bracket 450 and the base 600. The second spring cylinder damper 510 is connected between the second suspension bracket 440 and the base 600. The third spring cylinder damper 500 is connected between the bearing housing 400 and the base 600.

The first cylinder damper 540 is arranged between the first suspension bracket 450 and a rear side of the base in a tilted position, and the second cylinder damper 530 is arranged between the second suspension bracket 440 and the rear side of the base in a tilted position.

That is, the third spring cylinder damper 500 is arranged at a center of a rear side, and the first cylinder damper 540 and the second spring cylinder damper 510 are arranged on left/right sides of a front side. The first cylinder damper 540 and the second spring cylinder damper 510 are positioned on opposite sides of the third spring cylinder damper 500. That is, the spring dampers 500, 510 and 520 are arranged symmetry with the cylinder dampers 530 and 540 in left/right directions.

In the meantime, the tub 10 (specifically, the tub rear 120) of the washing machine of the present invention is supported rigidly more than the drum 30. To do this, the tub 10 can be supported on the cabinet base 600 by an additional supporter (not shown) and fixedly secured to the cabinet front (not shown) and the cabinet rear 620, additionally.

A state of fixation of the tub rear 120 to the cabinet rear 620 will be described with reference to the attached drawings.

Figure 7:
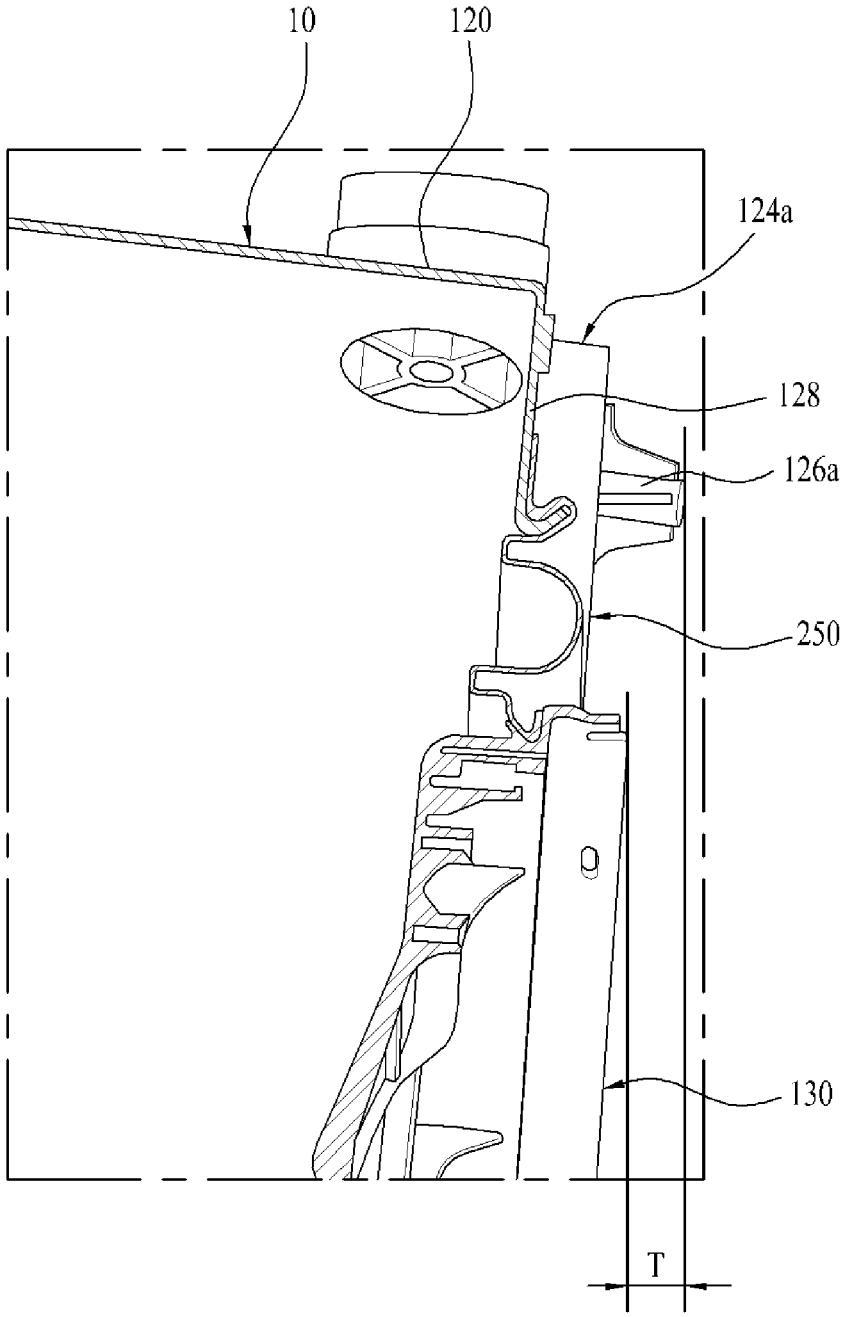
FIG. 7 illustrates a partial section of a rear side of a tub rear of a washing machine in accordance with a preferred embodiment of the present invention.
Figure 8:
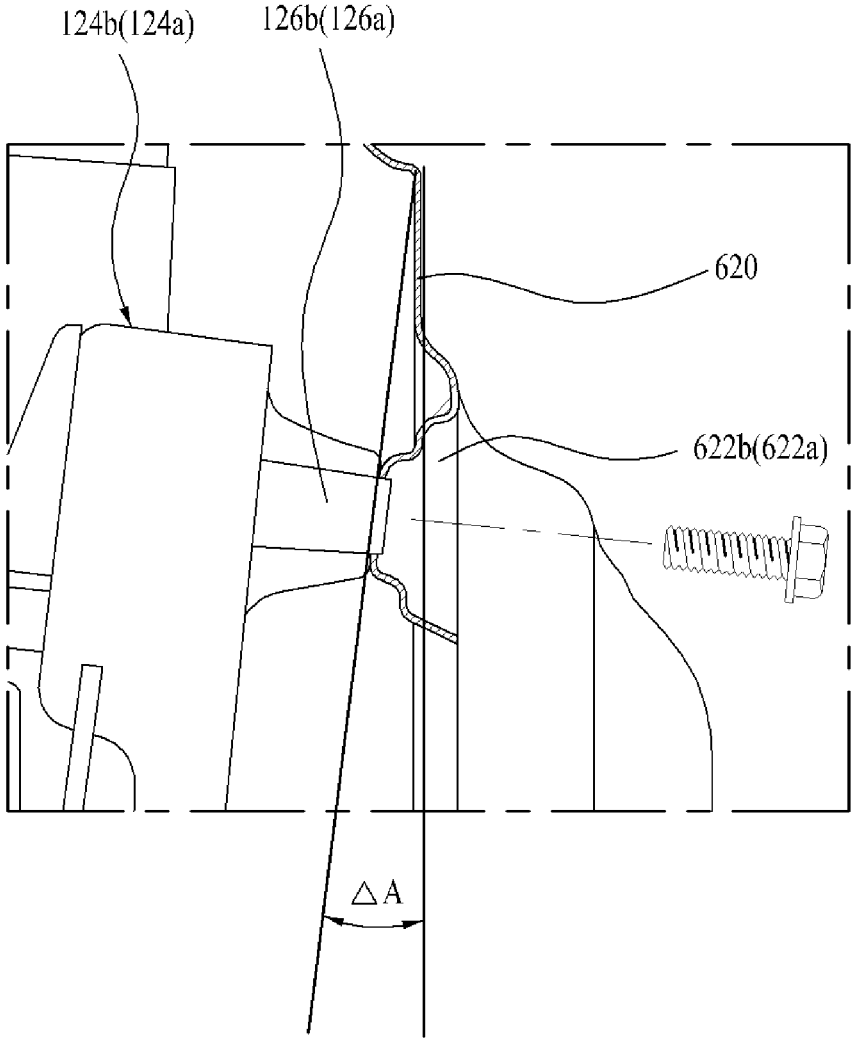
FIG. 8 illustrates a partial section showing a coupling state of a tub rear and a cabinet rear of a washing machine in accordance with a preferred embodiment of the present invention.

FIG. 7 illustrates a partial section of a rear side of a tub rear of a washing machine in accordance with a preferred embodiment of the present invention, and FIG. 8 illustrates a partial section showing a coupling state of a tub rear and a cabinet rear of a washing machine in accordance with a preferred embodiment of the present invention.

In the meantime, the tub rear 120 and the cabinet rear 620 have fastening structures at predetermined portions thereof respectively for fastening the tub rear 120 to the cabinet rear 620.

The tub rear 120 has coupling portions 124*a* and 124*b* on a rear side projected outward from a body of the tub rear 120 for coupling to the cabinet rear 620, respectively. That is, the coupling portions 124*a* and 124*b* are formed on an outer side of an outside circumferential surface of the tub rear 120. It is preferable that one pair of the coupling portions are provided on left/right sides of an upper side of the tub rear.

In the meantime, the coupling portions 124*a* and 124*b* have coupling bosses 126*a* and 126*b* projected parallel to the tub rear 120, respectively. The tub 10 is secured, not in a horizontal position, but in a tilted position such that a front side of the tub 10 is higher than the rear side of the tub 10. In addition to this, there are a plurality of reinforcing ribs 125*a* and 125*b* (See FIGS. 4 and 6) between the coupling portions 124*a* and 124*b* and the coupling bosses 126*a* and 126*b* for reinforcing strength of the coupling bosses 126*a* and 126*b*.

The coupling bosses 126*a* and 126*b* respectively projected from the coupling portions 124*a* and 124*b* are projected beyond a rear side of the bearing housing 400 positioned on a rear side of the tub 10 by predetermined distances T, respectively. The coupling bosses 126*a* and 126*b* are projected beyond a rear side of the bearing housing 400 by predetermined distances T thus because the tub 10 is secured more rigidly than the drum 30 and the bearing housing 400 vibrates in association with the vibration of the drum 30. That is, a space is formed between the cabinet rear 620 having the coupling bosses 126*a* and 126*b* coupled thereto and the bearing housing 400 for securing a space for the bearing housing 400 to vibrate therein. In this instance, in rear of the bearing housing 400, a motor may be mounted. Therefore, it is preferable that the coupling bosses 126*a* and 126*b* are formed extended more than the motor, respectively.

In the meantime, the cabinet rear 620 forms a rear side of the washing machine. The cabinet rear 620 has a service panel (not shown) at a center fastened so as to be able to open/close for maintenance of the washing machine separate from the cabinet rear 620. The cabinet rear 620 has securing portions 622*a* and 622*b* on an upper side spaced from the service panel for fastening to the coupling bosses 126*a* and 126*b* on the tub rear 120, respectively.

The securing portions 622*a* and 622*b* are projections toward an inside of the cabinet rear 620, i.e., toward the coupling bosses 126*a* and 126*b* on the tub rear 120, respectively. And, the securing portions 622*a* and 622*b* have end portions sloped by predetermined angles DA as much as the tilting angles of the coupling bosses 126*a* and 126*b* on the tub rear 120, respectively. In this instance, it is preferable that the predetermined angles of the end portions of the securing portions 622*a* and 622*b* are the same with the tilting angles of the tub 10. Eventually, the tub rear 120 positioned tilted by the predetermined angle and the cabinet rear 620 and the cabinet rear 620 mounted in a vertical position can be fastened together, closely.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A washing machine comprising:

a cabinet rear which forms a rear side of the washing machine;

a tub to receive wash water, the tub having a front side with an opening, a rear side with a rear opening, a circumferential side connecting the front and rear sides, a tub back provided in the rear opening, and a rear gasket sealably connected the tub back and the rear side of the tub respectively to prevent the washing water from leaking from the tub, wherein the tub is tilted by a predetermined angle such that the front side of the tub faces upward;

a rotatable drum provided in the tub;

a driving unit including a shaft connected to the drum through the tub back, a bearing housing coupled to the tub back to rotatably support the shaft, and a motor mounted to the bearing housing to rotate the shaft;

a suspension assembly connected to the bearing housing for supportably buffering vibration of the drum separately from the tub;

at least one coupler provided on an upper rear outer surface of the circumferential side of the tub, and configured to be fastened to the cabinet rear during a washing operation of the washing machine; and a coupling boss projecting from the at least one coupler, extending parallel to an axial line of the tub in a length direction of the tub toward the cabinet rear to be fixed to the cabinet rear, and extending beyond a rear side of the bearing housing by a predetermined distance, wherein the cabinet rear includes a securing base which projects toward the coupling boss to match a position of the coupling boss, the securing base having an end portion with a slope corresponding to a tilting angle of the tub.

2. The washing machine as claimed in claim 1, wherein the at least one coupler includes a pair of projections at right and left sides of the tub.

3. The washing machine as claimed in claim 1, wherein an end of the coupling boss extends beyond the driving unit in a rear direction of the tub.

4. The washing machine as claimed in claim 1, wherein the coupling boss includes a plurality of reinforcing ribs for reinforcing strength of the coupling boss.

5. The washing machine as claimed in claim 1, wherein a rigidity of a connection between a cabinet and the tub is greater than a rigidity of connection between the drum and the suspension unit.

6. The washing machine of claim 1, wherein the tub is tilted at an angle relative to horizontal axis of the washing machine.

* * * * *